US009761977B2

(12) United States Patent
Yang

(10) Patent No.: US 9,761,977 B2
(45) Date of Patent: Sep. 12, 2017

(54) CONDUCTIVE TERMINAL AND ELECTRICAL CONNECTOR

(71) Applicant: Molex, LLC, Lisle, IL (US)

(72) Inventor: Yun-Fang Yang, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/247,463

(22) Filed: Aug. 25, 2016

(65) Prior Publication Data

US 2017/0062964 A1 Mar. 2, 2017

(30) Foreign Application Priority Data

Aug. 31, 2015 (CN) ..... 2015 2 0669236 U

(51) Int. Cl.

| | |
|---|---|
| ***H01R 13/432*** | (2006.01) |
| ***H01R 13/04*** | (2006.01) |
| ***H01R 13/41*** | (2006.01) |
| ***H01R 43/16*** | (2006.01) |
| *H01R 4/18* | (2006.01) |

(52) U.S. Cl.

CPC ..... *H01R 13/04* (2013.01); *H01R 13/41* (2013.01); *H01R 43/16* (2013.01); *H01R 4/185* (2013.01)

(58) Field of Classification Search

CPC ..... H01R 13/432
USPC ..... 439/746, 748
See application file for complete search history.

(56) References Cited

U.S. PATENT DOCUMENTS

| | | | | |
|---|---|---|---|---|
| 4,607,907 | A * | 8/1986 | Bogursky | H01R 12/82 439/682 |
| 5,664,969 | A * | 9/1997 | Peterson | H01R 13/432 439/746 |
| 6,183,312 | B1 * | 2/2001 | Yamamoto | H01R 13/432 439/746 |
| 6,755,696 | B1 | 6/2004 | Ko | |
| 7,063,575 | B2 * | 6/2006 | Powers | H01R 11/05 439/699.2 |
| 7,112,105 | B2 * | 9/2006 | Wu | H01R 13/432 439/746 |

FOREIGN PATENT DOCUMENTS

| | | |
|---|---|---|
| CN | 201038421 Y | 3/2008 |
| TW | M519317 U | 3/2016 |

* cited by examiner

*Primary Examiner* — Neil Abrams
(74) *Attorney, Agent, or Firm* — James A. O'Malley

(57) ABSTRACT

A conductive terminal and an electrical connector are disclosed. The conductive terminal comprises a mating portion positioned at a front end, a tail portion for connecting a conductive wire and a fixed portion connected between the mating portion and the tail portion. Wherein the fixed portion comprises a bottom wall, two side walls bent upwardly respectively from two sides of the bottom wall, a lock tang obliquely extending rearwardly and upwardly from the middle of the bottom wall and two stopping protrusions protruding inwardly from the two side walls, the two stopping protrusions abut against the lock tang so as to prevent the lock tang from being improperly deformed due to a force applied. The present invention can assure that the conductive terminal is firmly fixed in insulative body of the electrical connector.

21 Claims, 7 Drawing Sheets

CONDUCTIVE TERMINAL AND ELECTRICAL CONNECTOR

RELATED APPLICATIONS

This application claims priority to Chinese Application No. 201520669236.4, filed Aug. 31, 2015, which is incorporated herein by reference in its entirety.

TECHNICAL FIELD

The present disclosure relates to an electrical connector, and more particularly relates to a conductive terminal which can be firmly fixed in electrical connector.

BACKGROUND ART

Chinese patent application CN03205740.7 discloses an electrical connector which comprises a conductive terminal and an insulative body, the conductive terminal comprises a front portion for mating with a terminal of a mating connector, a rear portion provided with a plurality of clamping tabs and electrically connected to a conductive wire and a fixed portion connecting the front portion and the rear portion, the fixed portion comprises a first upper plate portion adjacent to the front portion and a latch tang extending upwardly from the first upper plate portion toward the rear portion; the insulative body comprises a receiving passage penetrating the insulative body along a front-rear direction, the conductive terminal is received in the receiving passage, the latch tang is offset from a central axis of the conductive terminal, the receiving passage is provided with a recess offset from the central axis of the conductive terminal, the latch tang is received in the recess, both the latch tang and the first upper plate portion abut against the insulative body. When a relative large pulling force is applied to the conductive wire connected to the rear portion of the conductive terminal, the latch tang of such a conductive terminal is easily deformed due to the applied force and in turn is improperly folded, so that the conductive terminal is easily pulled rearwardly out of the insulative body, therefore it is desirable to further improve.

SUMMARY

A technical problem to be resolved by the present disclosure is to provide a conductive terminal and an electrical connector, which can assure that the conductive terminal is firmly fixed in an insulative body of the electrical connector so as to overcome the deficiency existing in the prior art.

In view of the above technical problem, the present disclosure provides a conductive terminal which is integrally formed by stamping a metal material; the conductive terminal comprises a mating portion positioned at a front end, a tail portion for connecting a conductive wire and a fixed portion connected between the mating portion and the tail portion. The fixed portion comprises a bottom wall, two side walls bent upwardly respectively from two sides of the bottom wall, a lock tang obliquely extending rearwardly and upwardly from the middle of the bottom wall and a stopping protrusion protruding inwardly from at least one of the two side walls, the stopping protrusion can abut against the lock tang so as to prevent the lock tang from being deformed due to a force applied.

In some embodiments, a protruding rib protrudes upwardly from an upper surface of the lock tang.

In some embodiments, the lock tang is formed by tearing upwardly the bottom wall from the middle of the bottom wall, and a top portion of the lock tang is lower than top portions of the two side walls.

In some embodiments, the bottom wall is firstly formed a straight extension portion extending rearwardly, and the lock tang is bent upwardly from a distal end of the straight extension portion.

In some embodiments, the two side walls are provided with a plurality of protruding points protruding outwardly from outer side surfaces of the two side walls.

In some embodiments, the protruding points provided to each of the two side walls comprise a first protruding point and a second protruding point protruding from the outer side surface of the side wall, and the second protruding point and the first protruding point are positioned at two different height levels.

In some embodiments, the amount of the stopping protrusion is two, the two stopping protrusions are respectively formed by tearing inwardly the two side walls, two distal ends of the two stopping protrusions can abut against an upper surface of the lock tang from two sides of the lock tang.

In some embodiments, the tail portion of the conductive terminal is a clamping portion with a U-shape for clamping the conducive wire; the mating portion is two contact arms respectively extending frontwardly from two front ends of the two side walls and approaching each other.

In view of the above technical problem, the present disclosure further provides an electrical connector comprising an insulative body and at least a conductive terminal mounted in the insulative body, the insulative body is provided with at least a receiving passage penetrating the insulative body along a front-rear direction for insertion of the conductive terminal, the insulative body is provided with a stopping portion on an inner wall of the receiving passage, the conductive terminal is the conductive terminal as previous described, the lock tang of the conductive terminal can abut against the stopping portion of the insulative body so as to prevent the conductive terminal from moving rearwardly out of the receiving passage.

In some embodiments, the stopping portion protrudes downwardly from the inner wall of the receiving passage, a front wall of the stopping portion is formed with an oblique surface which is low at the front and high at the rear, a distal end of the lock tang is provided with a bottom-side chamfer which is matched with the oblique surface.

In comparison with the prior art, in the present disclosure, a lock tang obliquely extends upwardly and rearwardly from the middle of the bottom wall of the conductive terminal, and at least one stopping protrusion protrudes inwardly from at least one of the two side walls at a position which is located above the lock tang and close to the front end of the lock tang, the stopping protrusion abuts against the lock tang, when a relative large pulling force is applied to the conductive wire at the rear of the conductive terminal, the butting protrusion prevents the lock tang from being improperly folded due to deformation under the applied pulling force, and in turn prevents the conductive terminal from being pulled rearwardly out of the insulative body, so it assures that the conductive terminal is firmly fixed in the insulative body.

DETAILED DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature are intended to describe a feature of an example of the Present Disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Hereinafter, an embodiment of the present disclosure will be further described in detail in combination with figures.

Figure 1:
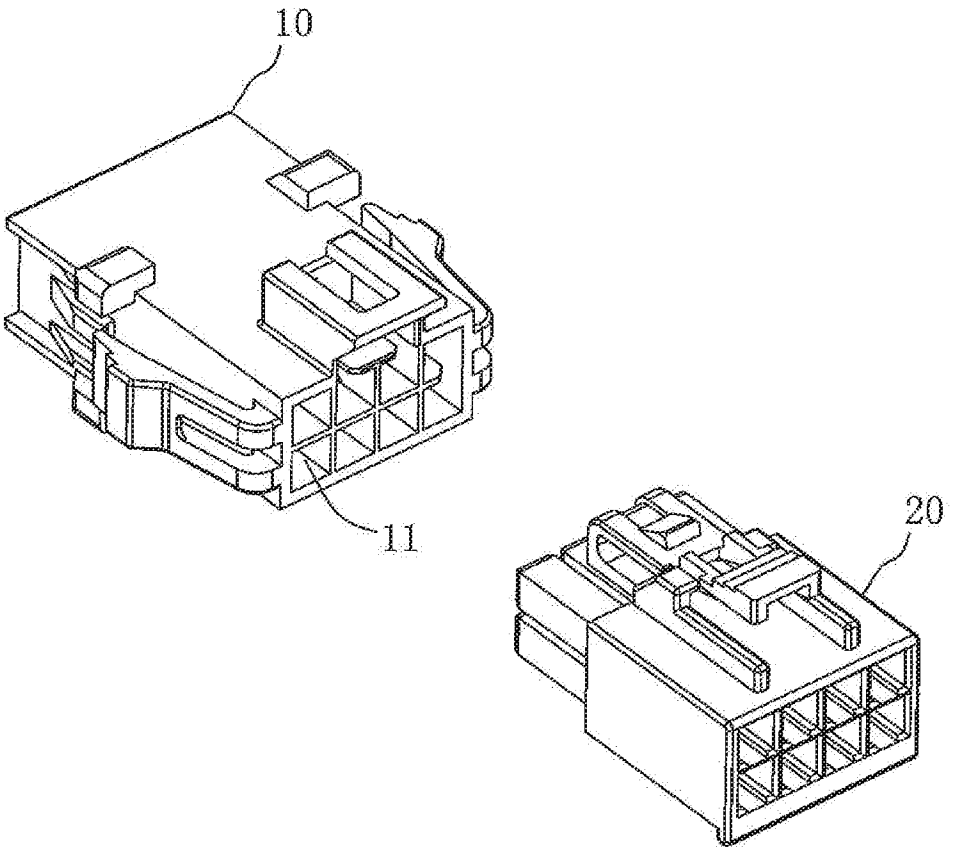
FIG. 1 is an exploded perspective view of an embodiment of an electrical connector of the present disclosure and a mating connector.
Figure 2:
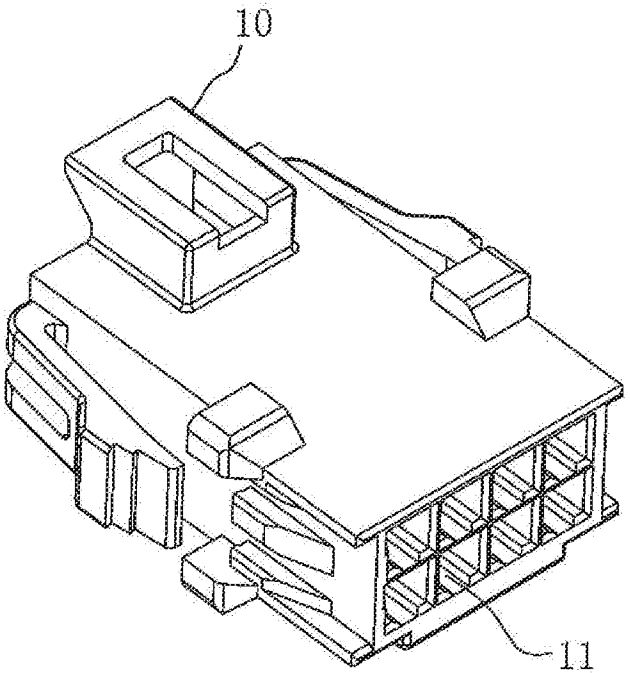
FIG. 2 is a perspective view of the embodiment of the electrical connector of the present disclosure.
Figure 3:
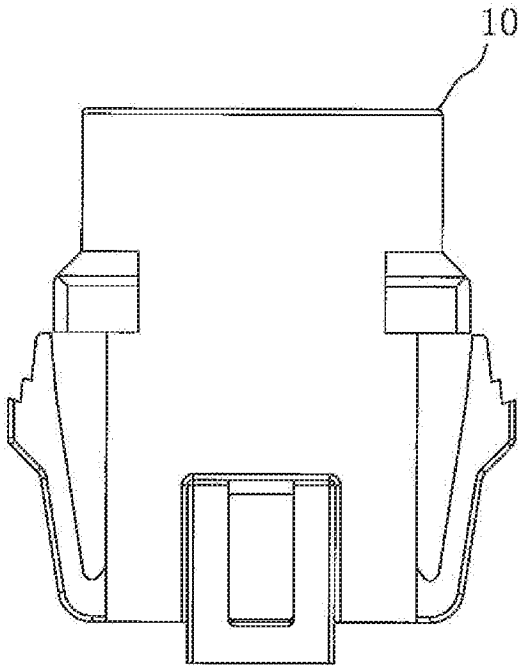
FIG. 3 is a top view of the embodiment of the electrical connector of the present disclosure.
Figure 4:
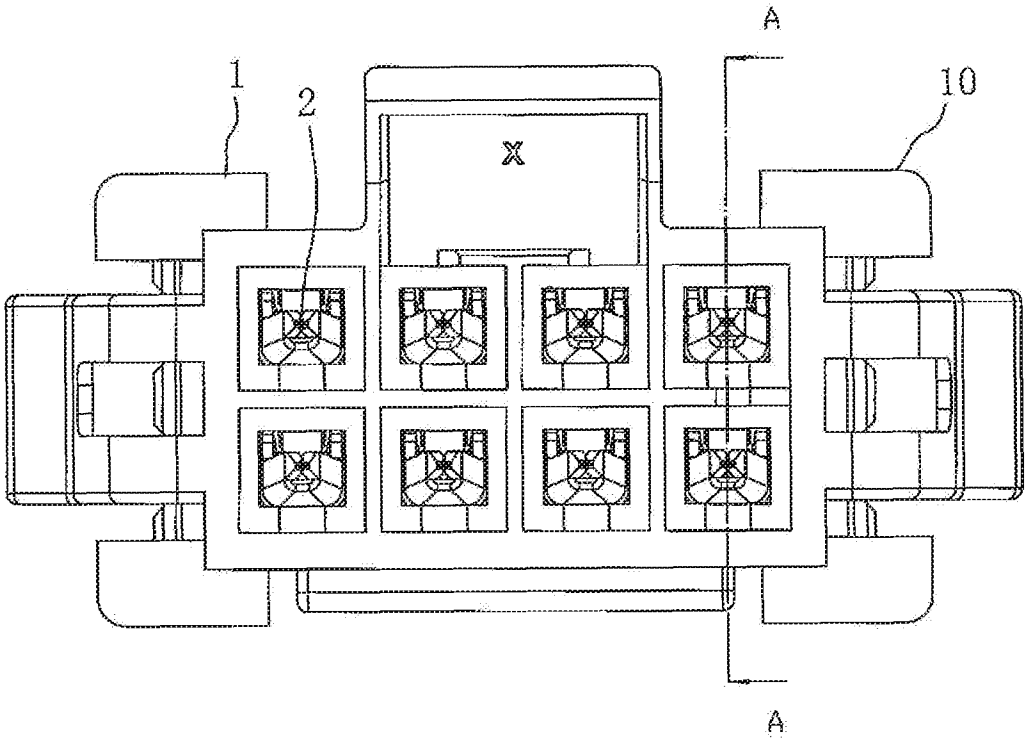
FIG. 4 is a front view of the embodiment of the electrical connector of the present disclosure.
Figure 5:
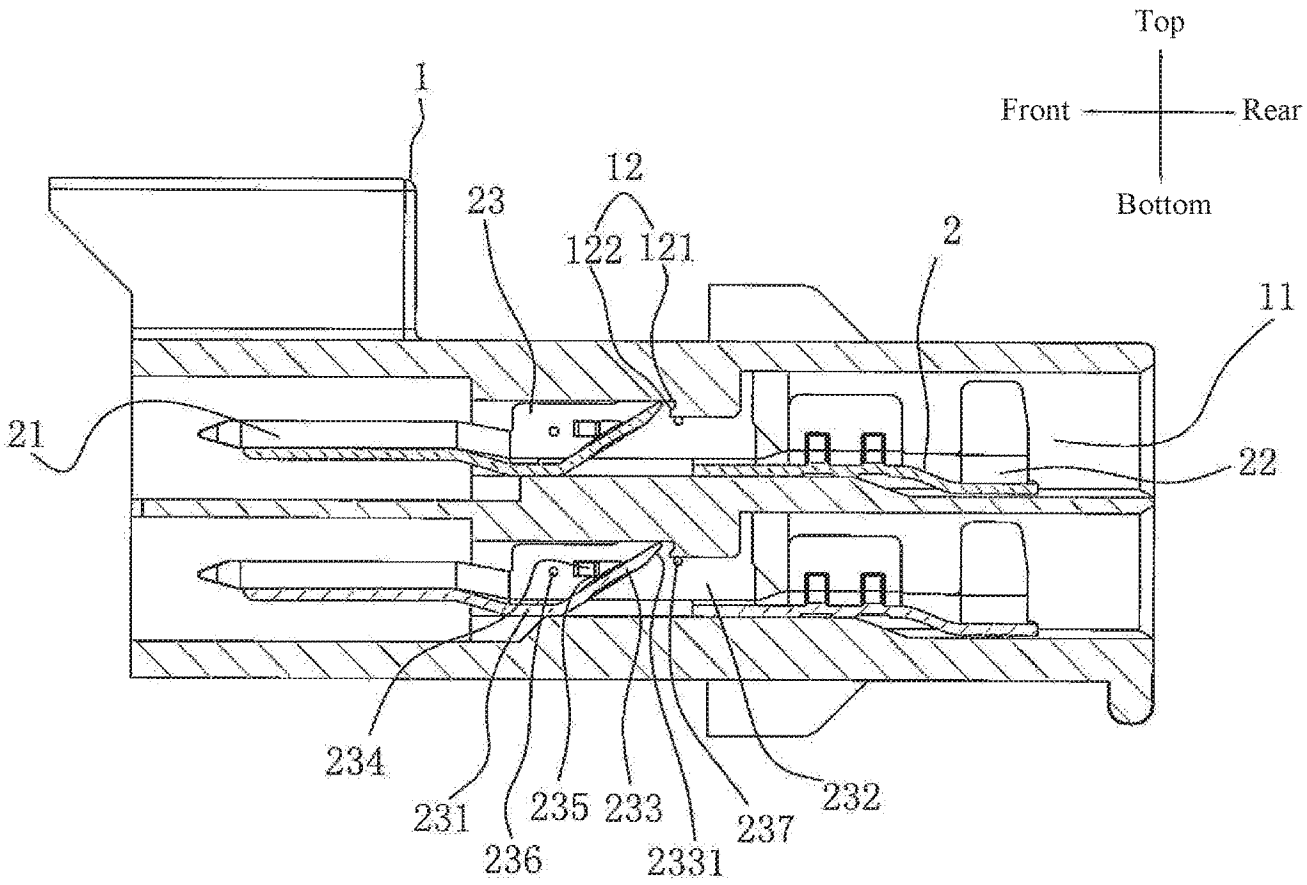
FIG. 5 is a cross sectional view taken along a line A-A of FIG. 4.

Referring to FIG. 1 to FIG. 4, the present disclosure provides an electrical connector 10. Preferably, the electrical connector 10 may pass through and may be fixed to a circuit board (not shown) in a manner of pass through the circuit board, and can be mated with a mating connector 20. The electrical connector 10 generally comprises: an insulative body 1 and at least a conductive terminal 2 fixed in the insulative body 1. The insulative body 1 is opened with at least a receiving passage 11 penetrating the insulative body 1 along a front-rear direction, a stopping portion 12 protrudes downwardly from an inner wall of each receiving passage 11. Each receiving passage 11 may correspondingly receive one conductive terminal 2, each stopping portion 12 may prevent one corresponding conductive terminal 2 from moving rearwardly out of the corresponding receiving passage 11. Referring to FIG. 5, in the embodiment, an upper side of the stopping portion 12 has a front wall surface 121 which is vertical, a lower side of the stopping portion 12 protrudes frontwardly relative to the front wall surface 121 and is formed with an oblique surface 122 which is low at the front and high at the rear.

Figure 6:
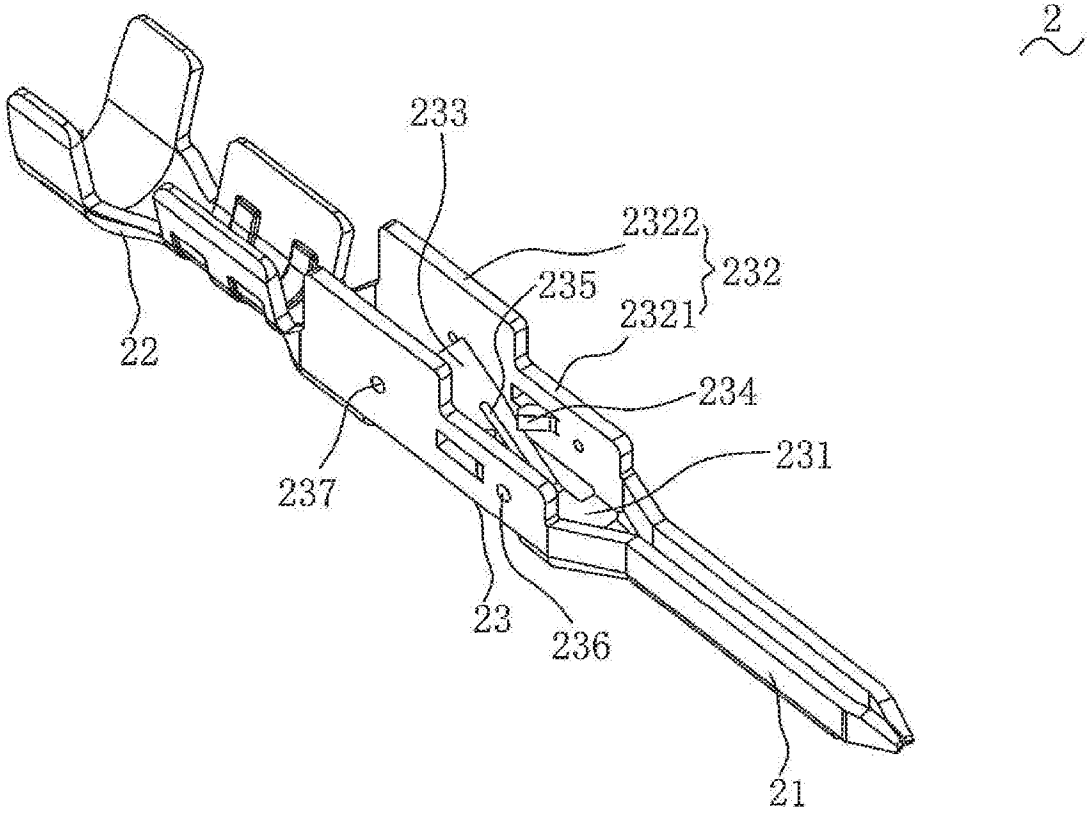
FIG. 6 is a perspective view of a conductive terminal of the embodiment of the electrical connector of the present disclosure.
Figure 7:
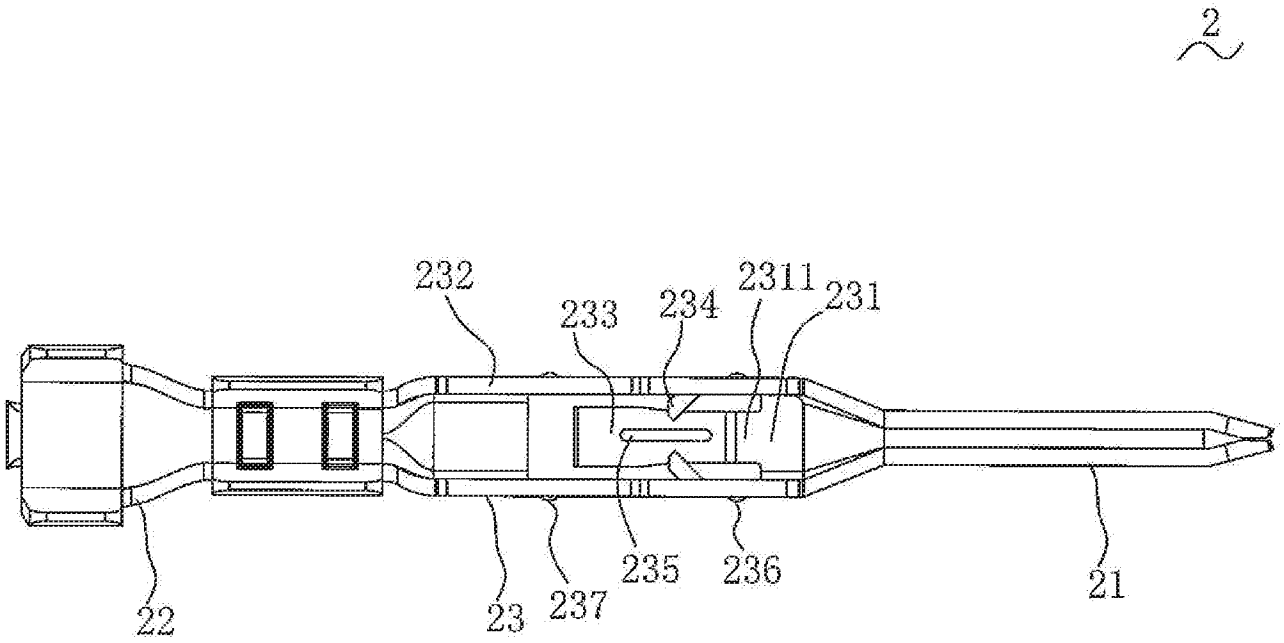
FIG. 7 is a top view of the conductive terminal of the embodiment of the electrical connector of the present disclosure.

Referring to FIG. 5, FIG. 6 and FIG. 7, the conductive terminal 2 is integrally formed by stamping a metal material. The conductive terminal 2 comprises a mating portion 21 positioned at a front end, a tail portion 22 for connecting a conductive wire (not shown) and a fixed portion 23 connected between the mating portion 21 and the tail portion 22. The fixed portion 23 comprises a bottom wall 231 positioned at the bottom and two side walls 232 bent upwardly from two sides of the bottom wall 231. Each side wall 232 is composed of a first part 2321 which is positioned at the front and is low and a second part 2322 which is positioned at the rear and high. The mating portion 21 is two contact arms which respectively extend frontwardly from the two side walls 232 and approach each other. The tail portion 22 is a clamping portion with a U-shape for clamping the conductive wire. It is noted that, the two side walls 232 are provided with four protruding points 236, 237 protruding from outer side surfaces of the two side walls 232. Specifically, the two first parts 2321 of the two side walls 232 are provided with the two first protruding points 236 respectively protruding from two outer side surfaces of the two first parts 2321, the two second parts 2322 of the two side walls 232 are provided with the two second protruding points 237 respectively protruding from two outer side surfaces of the two second parts 2322. Preferably, the second protruding point 237 and the first protruding point 236 are respectively positioned at two different height levels. With this configuration, by that the first protruding point 236 and the second protruding point 237 positioned at two different height levels contact the insulative body 1, it may assure that the conductive terminal 2 is stably mounted in the receiving passage 1.

The fixed portion 23 further comprises a lock tang 233 obliquely extending upwardly and rearwardly from the middle of the bottom wall 231. The lock tang 233 is formed by tearing upwardly the bottom wall 231 from the middle of the bottom wall 231 and a top portion of the lock tang 233 is lower than top portions of the two side walls 232. Specifically, the bottom wall 231 is firstly formed with a straight extension portion 2311 extending rearwardly, and the lock tang 233 is bent upwardly from a distal end of the straight extension portion 2311. After the conductive terminal 2 has been inserted into the receiving passage 11 of the insulative body 1 from the rear to the front, the lock tang 233 will rebound upwardly so as to abut against the stopping portion 12 of the insulative body 1, thereby preventing the conductive terminal 2 from moving rearwardly out of the receiving passage 11. A front end of the lock tang 233 is positioned between the two first parts 2321 of the two side walls 232, a rear end of the lock tang 233 is positioned between the two second parts 2322 of the two side walls 232. Such a lock tang 233 is positioned between the two side walls 232 and is lower than the top portions of the two side walls 232, which may prevent the lock tang 233 from being deformed due to hooking and hitting of the receiving passage 11. It is noted that, the lock tang 233 is provided with a protruding rib 235 protruding from an upper surface of the lock tang 233, which can reduce the deformation of the lock tang 233. In addition, a distal end of the lock tang 233 is provided with a bottom-side chamfer 2331 which is matched with the oblique surface 122 so as to allow the conductive terminal 2 to be reliably engaged with the stopping portion 12 and prevent the conductive terminal 2 from being unintentionally pulled out rearwardly.

The fixed portion 23 further comprises two stopping protrusions 234 respectively formed by inwardly tearing the two side walls 232 at positions which are located above the lock tang 233 and close to the front end of the lock tang 233

(in some embodiments which are not shown, only one stopping protrusion 234 may be provided), two distal ends of the two stopping protrusions 234 can abut against the upper surface of the lock tang 233 from two sides of the lock tang 233. When a relative large pulling force is applied to the conductive wire at the rear of the conductive terminal 2, the two stopping protrusions 234 can abut against the lock tang 233 from the two sides of the lock tang 233, prevent the lock tang 233 from being improperly folded due to deformation under the applied pulling force, and in turn prevent the conductive terminal 2 from being pulled rearwardly out of the receiving passage 11 of the insulative body 1. Specifically, the two stopping protrusions 234 respectively extend inwardly from the two first parts 2321 of the two side walls 232.

In the electrical connector 10 of the present disclosure, a lock tang 233 obliquely extends upwardly and rearwardly from the middle of the bottom wall 231 of the conductive terminal 2, the lock tang 233 positioned between the two side walls 232 and lower than the top portions of the two side walls 232, the lock tang 233 may be prevented from being deformation due to unexpected crash; and the two stopping protrusions 234 protrude inwardly respectively from the two side walls 232 at somewhat near the front portion of the lock tang 233, the two stopping protrusions 234 may prevent the lock tang 233 from being deformed due to an excessive pull force applied, and in turn prevent the conductive terminal 2 from being pulled rearwardly out of the insulative body 1, so that it can assure that the conductive terminal 2 is firmly fixed in the insulative body 1.

The above contents are only embodiment of the present disclosure and are not used to limit the implementing solutions of the present disclosure. Those skilled in the art may conveniently vary or modify based on the main concept and spirit of the present disclosure, therefore the extent of protection of the present disclosure shall be determined by the terms of the Claims.

What is claimed is:

1. A conductive terminal, which is integrally formed by stamping a metal material, the conductive terminal comprising:

a mating portion, a tail portion positioned rearward of the mating portion; and a fixed portion connected between the mating portion and the tail portion, wherein the fixed portion comprises a bottom wall, first and second side walls, a lock tang and a stopping protrusion, the bottom wall having a middle and first and second sides, the first side wall extending upwardly from the first side of the bottom wall, the second side wall extending upwardly from the second side of the bottom wall, the lock tang extending rearwardly and upwardly from the middle of the bottom wall, the stopping protrusion protruding inwardly from the first side wall, the stopping protrusion being formed by tearing inwardly from the first side wall, the stopping protrusion configured to abut against the lock tang.

2. The conductive terminal according to claim 1, wherein a protruding rib protrudes upwardly from an upper surface of the lock tang.

3. The conductive terminal according to claim 1, wherein the lock tang is formed by tearing upwardly from the middle of the bottom wall.

4. The conductive terminal according to claim 3, wherein the bottom wall is firstly formed a straight extension portion extending rearwardly, and the lock tang is bent upwardly from a distal end of the straight extension portion.

5. The conductive terminal according to claim 1, wherein the first and second side walls are each provided with a plurality of protruding points protruding outwardly from outer side surfaces thereof.

6. The conductive terminal according to claim 5, wherein each of the first and second side walls has first and second protruding points protruding from the outer side surface thereof, the second protruding point being positioned at a different height level than the first protruding point.

7. The conductive terminal according to claim 1, wherein the stopping protrusion is a first stopping protrusion, and further comprising a second stopping protrusion protruding inwardly from the second side wall, the second stopping protrusion being formed by tearing inwardly from the second side wall, the second stopping protrusion configured to abut against the lock tang.

8. The conductive terminal according to claim 1, wherein the tail portion is a clamping portion with a U-shape for clamping a conducive wire.

9. The conductive terminal according to claim 3, wherein a top portion of the lock tang is lower than top portions of the first and second side walls.

10. The conductive terminal according to claim 1, wherein the mating portion is formed of first and second contact arms, the first contact arm extending forwardly from a front end of the first side wall, the second contact arm extending forwardly from a front end of the second side wall.

11. An electrical connector, comprising:

an insulative body, the insulative body being provided with a receiving passage penetrating the insulative body along a front-rear direction, the insulative body being provided with a stopping portion on an inner wall of the receiving passage; and a conductive terminal mounted within the receiving passage of the insulative body, the conductive terminal having a mating portion, a tail portion and a fixed portion, the tail portion being positioned rearward of the mating portion, the fixed portion connected between the mating portion and the tail portion, wherein the fixed portion comprises a bottom wall, first and second side walls, a lock tang and a stopping protrusion, the bottom wall having a middle and first and second sides, the first side wall extending upwardly from the first side of the bottom wall, the second side wall extending upwardly from the second side of the bottom wall, the lock tang extending rearwardly and upwardly from the middle of the bottom wall, the stopping protrusion protruding inwardly from the first side wall, the stopping protrusion being formed by tearing inwardly from the first side wall, the stopping protrusion abutting against the stopping portion of the insulative body so as to prevent the conductive terminal from moving rearwardly out of the receiving passage.

12. The electrical connector according to claim 11, wherein the stopping portion protrudes downwardly from the inner wall of the receiving passage, a front wall of the stopping portion is formed with an oblique surface which is low at a front and high at a rear, a distal end of the lock tang is provided with a bottom-side chamfer which is matched with the oblique surface.

13. The electrical connector according to claim 11, wherein a protruding rib protrudes upwardly from an upper surface of the lock tang.

14. The electrical connector according to claim 11, wherein the lock tang is formed by tearing upwardly from the middle of the bottom wall.

15. The electrical connector according to claim 14, wherein a top portion of the lock tang is lower than top portions of the first and second side walls.

16. The electrical connector according to claim 14, wherein the bottom wall is firstly formed a straight extension portion extending rearwardly, and the lock tang is bent upwardly from a distal end of the straight extension portion.

17. The electrical connector according to claim 11, wherein the first and second side walls are each provided with a plurality of protruding points protruding outwardly from outer side surfaces thereof.

18. The electrical connector according to claim 17, wherein each of the first and second side walls has first and second protruding points protruding from the outer side surface thereof, the second protruding point being positioned at a different height level than the first protruding point.

19. The electrical connector according to claim 11, wherein the stopping protrusion is a first stopping protrusion, and further comprising a second stopping protrusion protruding inwardly from the second side wall, the second stopping protrusion being formed by tearing inwardly from the second side wall, the second stopping protrusion configured to abut against the lock tang.

20. The electrical connector according to claim 11, wherein the tail portion is a clamping portion with a U-shape for clamping a conducive wire.

21. The electrical connector according to claim 11, wherein the mating portion is formed of first and second contact arms, the first contact arm extending forwardly from a front end of the first side wall, the second contact arm extending forwardly from a front end of the second side wall.

* * * * *